United States Patent [19]

Sawyer

[11] 4,057,876

[45] Nov. 15, 1977

[54] METHOD AND APPARATUS FOR CONVEYING AND BREAKING APART FIBER MODULES

[76] Inventor: Joe F. Sawyer, 3602 Gila Trail, Temple, Tex. 76501

[21] Appl. No.: 621,385

[22] Filed: Oct. 10, 1975

[51] Int. Cl.[2] ..... D01G 7/10

[52] U.S. Cl. ..... 19/80 R; 214/38 BB

[58] Field of Search ..... 19/80 R, 81, 145.5; 241/277, 279, 223; 214/57, 38 BB, 310, 311

[56] References Cited

U.S. PATENT DOCUMENTS

| | | | |
|---|---|---|---|
| 1,248,995 | 12/1917 | Bauman et al. | 214/38 BB X |
| 2,127,972 | 8/1938 | Hutchinson et al. | 214/38 BB X |
| 3,208,107 | 9/1965 | Kotter et al. | 19/80 R X |
| 3,379,324 | 4/1968 | Wallace et al. | 19/80 R X |
| 3,897,018 | 7/1975 | Wilkes et al. | 241/223 |
| 3,949,448 | 4/1976 | Willcutt et al. | 19/80 R |

FOREIGN PATENT DOCUMENTS

| | | | |
|---|---|---|---|
| 645,655 | 6/1937 | Germany | 19/80 R |
| 946,333 | 1/1964 | United Kingdom | 19/80 R |

*Primary Examiner*—Dorsey Newton

[57] ABSTRACT

A fiber module, or block of compacted fiber material, is conveyed and broken apart, or separated, into many loose uncompacted fibers. In the method a fiber module is removed from a carrier and moved upon a shuttle carriage, which is moved laterally into axial alignment with a horizontal bed. The fiber module is conveyed onto the bed and then conveyed along the bed to a breaker device, wherein the fiber module is broken apart.

The apparatus useful for carrying out the above method includes, in combination, a shuttle carriage capable of lateral movement with respect to a generally horizontal bed, the bed having a plurality of sets of power driven rollers disposed within it; and a breaker device having a plurality of rotary breaker tubes located within it.

10 Claims, 6 Drawing Figures

METHOD AND APPARATUS FOR CONVEYING AND BREAKING APART FIBER MODULES

BACKGROUND OF THE INVENTION

1. Field of the Invention

The invention relates to the continuous conveying and breaking apart of fiber modules wherein the fiber material which is broken apart, or separated, from the module is then conveyed to subsequent fiber handling apparatus, such as a cotton gin.

2. Description of the Prior Art

U.S. Pat. No. 3,749,003, issued to Lambert H. Wilkes and Joseph K. Jones on July 31, 1973, discloses a mechanized seed cotton handling apparatus wherein seed cotton from mechanical cotton harvesters is compacted onto a pallet. The compacted cotton may then be transported on a conventional flat-bed trailer to a cotton gin. Although this apparatus yields storage advantages in cotton fields and storage areas of cotton gins, in comparison with the earlier systems involving transportation and storage of uncompacted cotton, a problem exists with respect to feeding the compacted cotton into a cotton gin. For example, using this system it is necessary for workmen, using the conventional suction pipe for feeding cotton gins, to walk along the top of the compacted cotton and vacuum it into the cotton gin — an extremely slow process due to the compacted nature of the cotton fibers.

U.S. Pat. No. 3,897,018, issued to Lambert H. Wilkes, Gary L. Underbrink, and Joseph K. Jones on July 29, 1975, discloses an improvement over U.S. Pat. No. 3,749,003, in an apparatus for continuously feeding compressed cotton carried by a pallet into a cotton gin, which includes a breaker device for facilitating the removal of compressed cotton from the pallet. The breaker device, consisting of a plurality of rotatably mounted spiral auger blades and spikes, is disposed near the end of a horizontal bed which has a plurality of powered and idler rollers supported therein. At one end of the bed, a rotating endless chain is provided for engagement with a hook carried by each pallet. In use, a conventional truck and flat-bed trailer, which is loaded with a pallet, is backed up to the end of the bed and the hook is attached to the endless chain which pulls the loaded pallet onto the bed. Then the powered rollers come into contact wih the pallet and convey it to the breaker device.

A major problem encountered in using this Wilkes et al feeding apparatus, or similar feeding apparatus, is the necessity for accurately aligning the loaded trailer with the end of the bed, so that the endless chain can be readily engaged by the pallet hook in order to pull the pallet onto the bed. Since the pallets used are normally 24 or 32 feet in length, the trailers used are approximately 30 or 38 feet in length. The difficulty of backing-up a 30 or 38 foot long trailer to the end of the bed, such that the pallet hook is accurately aligned with the endless chain, is readily apparent. This difficulty is further increased if the pallet is not placed on the trailer with its longitudinal axis parallel with that of the trailer — a not infrequent occurrence.

Other factors have also been found to worsen this alignment problem. During the cotton harvesting season many cotton gins are operated on a 24 hour basis. Aligning a trailer with the bed at night or under adverse weather conditions, e.g., during a rain or dust storm, has been found to be quite difficult.

Another shortcoming of this Wilkes et al feeding apparatus is the amount of time lost by trucks which are waiting to unload their pallets, while another truck is attempting to align its trailer with the bed. Such unwanted delays in unloading the trailers further disrupt the desired continuous feeding of fiber material into the cotton gin, which increases the operating costs of the cotton gin.

Another problem found to exist in using this Wilkes et al feeding apparatus, or similar feeding apparatus, relates to its conveyor system. Although it is desired to have the loaded pallets in an end-to-end abutting relationship as they travel into the breaker device, such positioning is difficult to attain with the Wilkes et al apparatus because of inadequate speed control of the various conveyors. Additionally, the prior art systems have difficulty in continuously feeding compressed cotton into the breaker device fast enough to supply high-capacity cotton gins.

Accordingly, prior to the development of the present invention, there has been no method or apparatus available for efficiently conveying and breaking apart fiber modules which does not have an inherent alignment problem during the unloading of a trailer. Therefore, the art has sought an efficient method and apparatus for conveying and breaking apart fiber modules absent the problems of previously proposed feeding apparatus.

SUMMARY OF THE INVENTION

In accordance with the invention the foregoing has been achieved through the present method and apparatus for conveying and breaking apart fiber modules. With the method of the present invention after a fiber module is removed from a carrier, the fiber module is moved upon a transfer means. The transfer means and fiber module are then moved laterally to a location axially aligned with a supporting means which has a receiving zone at one end thereof. The fiber module is conveyed along the supporting means to a breaker means which breaks apart the fiber module. After the fiber module has been broken apart, it is removed from the breaker means.

The present invention also includes apparatus for conveying and breaking apart fiber modules, wherein the apparatus comprises in combination:

a means for supporting at least one fiber module in a generally horizontal position, which support means has a fiber module receiving zone at one end thereof and a fiber module delivery zone, which is spaced from the receiving zone;

means for breaking apart a fiber module, which breaking means is located adjacent to the fiber module delivery zone of the support means;

first drive means for conveying a fiber module along the support means from the receiving zone to the breaker means;

means for transferring a fiber module from a first location laterally displaced from the support means to a second location which is axially aligned with the receiving zone of the support means; and second drive means for conveying a fiber module from the transfer means to the receiving zone of the support means.

As indicated above, in more specific terms, the apparatus of the present invention includes a shuttle carriage serving as the transfer means. The shuttle carriage has a plurality of power driven rollers supported within it for conveying a fiber module from the shuttle carriage to the receiving zone of the supporting means. The support means includes a generally horizontal bed which has a plurality of power driven roller sets located within the frame of the bed. The power driven roller sets convey a fiber module along the bed into a breaker means.

A feature of the present invention resides in the fact that a control means is associated with the sets of power driven rollers which enables the sets of power driven rollers to be operating at different speeds, thus enabling subsequent fiber modules conveyed onto the bed to "catch up with" or "bump" preceding fiber modules and form a continuous stream of abutting fiber modules as they are conveyed into the breaker means.

The method and apparatus of the present invention when compared with previously proposed prior art apparatus have the advantages of efficiency, elimination of truck alignment problems, and adequate speed control necessary for assuring that a continuous stream of fiber modules is conveyed into the breaker means.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
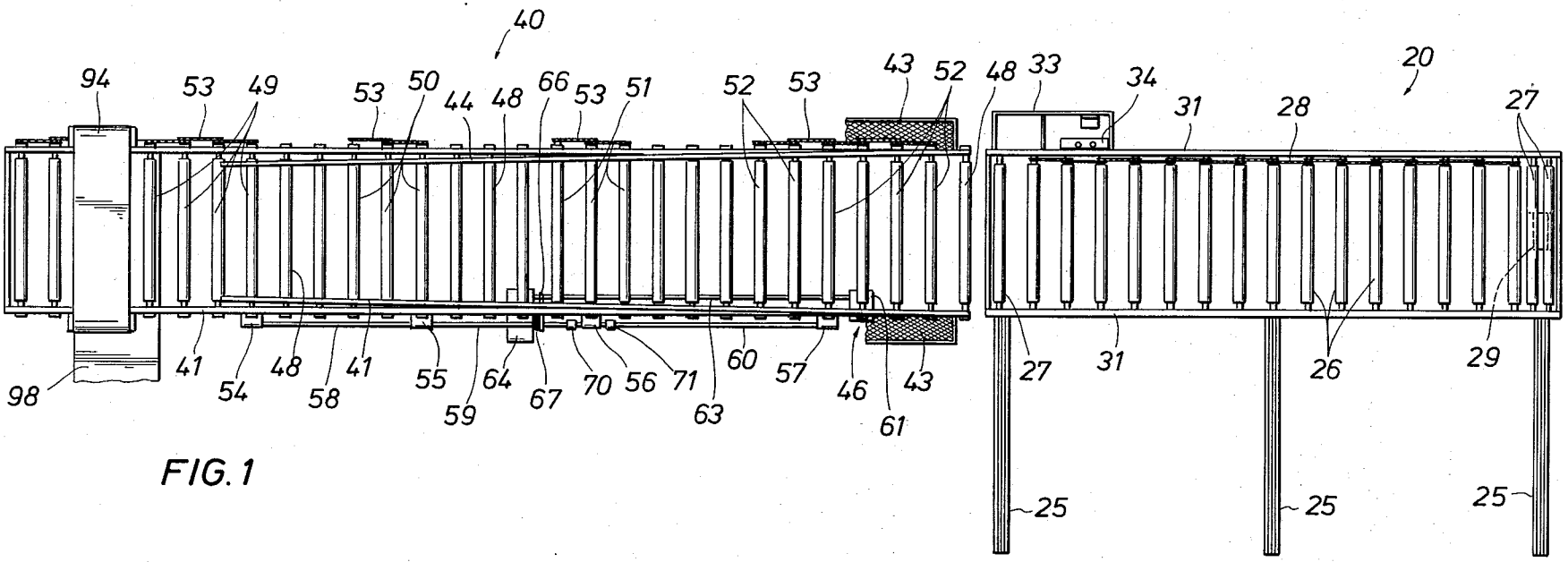
FIG. 1 is a cross sectional view of the apparatus of the present invention taken along line 1—1 of FIG. 2.
Figure 2:
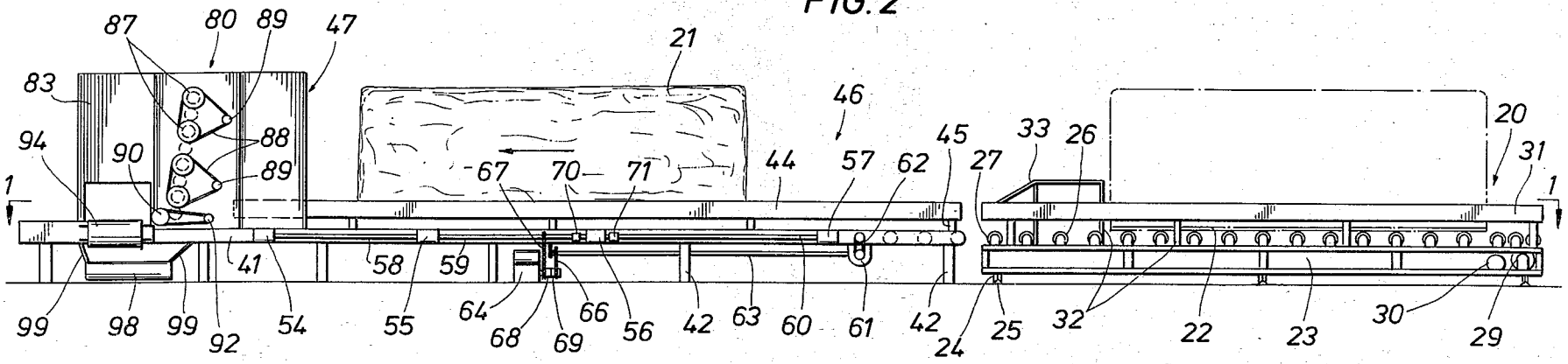
FIG. 2 is a side view of the apparatus of the present invention.

Turning first to FIGS. 1 and 2, the general configuration of the various elements of an apparatus for conveying and breaking apart fiber modules, which achieves the advantages previously described, is shown as comprising a transfer means or shuttle carriage 20, a support means or horizontal bed 40, and a breaker means 80. The fiber module 21, or block of compacted fibers, is conveyed on a pallet 22, which may be made of any suitable material, for example, wood, metal, plywood, or plastic. It has been found that a particularly good material is fiberglass. The pallet 22 may have a plurality of transverse and longitudinal ribs located beneath the pallet to provide additional strength thereto. The pallet has suitable attachment means, for example, eyelets, provided at both ends to enable the pallet to be engaged by a pulling device for moving the pallet. Although the apparatus disclosed herein may accommodate pallets of varying length, the pallets normally used are either twenty-four or thirty-two feet in length. The fibers, which preferably may be seed or lint cotton, may be compacted by any suitable device, an example of which is the device disclosed in U.S. Pat. No. 3,749,003. The method and apparatus herein disclosed is, of course, suitable for handling any fiber material capable of being compacted.

The transfer means or shuttle carriage 20, comprises a generally horizontal rectangular frame 23 which is mounted on wheels 24 for lateral movement along tracks 25. The frame 23 supports a plurality of rotatably mounted power driven rollers 26 and idler rollers 27. The rollers 26 comprise a generally horizontal fiber module receiving surface which has a plane on the same plane as that of the support means 40. At one end of each of the power driven rollers, conventional sprockets (not shown) are mounted for engagement with a plurality of interconnected drive chains 28, which supply a rotational force to each of the rollers 26. Located beneath two of the idler rollers 27 at one end of the frame 23 is a winch 29. The winch 29 is provided with a suitable cable and hook (not shown) to be used for pulling a fiber module 21 and pallet 22 upon the shuttle carriage 20, as to be hereinafter described. A preferred material to be used for the cable is a heavy-duty nylon strap, which provides great strength with little weigh. A suitable motor and clutch arrangement 30 is provided for supplying power to the interconnected drive chains 28, winch 29, and wheels 24. A fiber module guide means or module guide rails 31 are connected to the frame 23 along both sides thereof via a plurality of posts 32, such that the guide rails are positioned above the rollers 26 and 27. This guide rail location is desired so that the guide rails 31 will be in contact only with the fiber module 21, and not the pallet 22. Finally, a shuttle carriage operator's platform 33 is mounted along one side of frame 23. The platform 33 includes an appropriate control panel 34 for housing the controls for the winch 29, power driven rollers 26, and wheels 24. Any suitable controls may be used and are connected in any conventional manner.

It should be noted that any suitable lateral movement means could be used so long as the shuttle carriage 20 will be axially aligned with the bed 40. For example, six wheels and three tracks are not a necessity and in some applications 4 wheels and two tracks could suffice. Likewise, more wheels and tracks could be used or the shuttle carriage could be placed upon an endless conveyor belt or suspended from an overhead crane which could provide the requisite lateral movement and axial alignment.

Figure 3:
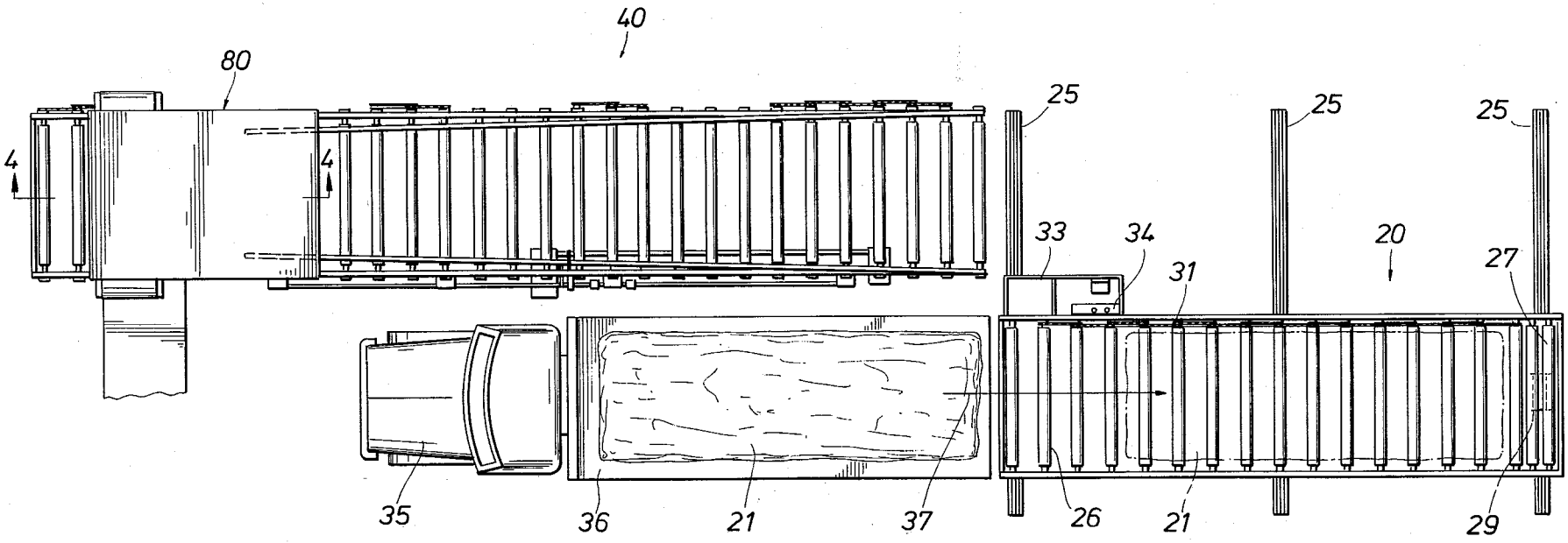
FIG. 3 is a plan view of the apparatus of FIG. 2 depicting a trailer being unloaded.

The operation of the shuttle carriage 20 will now be described with reference to FIGS. 1 and 3. With the shuttle carriage 20 in the location shown in FIG. 1, a carrier such as, for example, a conventional truck 35 and flat-bed trailer 36, is driven straight along side the bed 40, with the end of the trailer 36 approximately aligned with the end of the bed 40 as shown in FIG. 3. The trailer 36 carries a fiber module 21 which is disposed upon a pallet 22. Then power is supplied to the wheels 24 of the shuttle carriage 20 and it is moved laterally of the bed 40 to a first location where it is longitudinally aligned with the trailer 36 as shown in FIG. 3. At this point a workman unreels the hook and strap from winch 29 and attaches the hook and strap to the eyelet at the end of the pallet which is disposed upon the trailer 36. Then the shuttle carriage operator, through the control panel 34, activates the winch 29 in order to transfer, or pull, the fiber module 21 upon the shuttle carriage 20 in the direction shown by arrow 37. While the fiber module 21 is being pulled onto the shuttle carriage 20, the module guide rails 31 serve to guide and align the module along the length of the shuttle carriage 20. If in the event the longitudinal axis of the fiber module 21 and pallet 22 are not in alignment with the longitudinal axis of the trailer 36, the guide rails 31 greatly facilitate the initial movement of the module 21 and pallet 22 onto the shuttle carriage 20 and put the fiber module into axial alignment with the shuttle carriage 20. After the entire module 21 has been placed upon the shuttle carriage, the pallet 22 is disengaged from the winch. The shuttle carriage operator, through the control panel, then supplies power to the wheels 24 and causes the shuttle carriage, which now carries the module 21 and pallet 22, to be moved along the rails 25 to a second location axially aligned with the bed 40 as shown in FIG. 1. The truck is now ready to drive away from the bed 40 in order to pick up another fiber module. As soon as the shuttle carriage is axially aligned with the bed 40, as shown in FIG. 1, the shuttle carriage operator, through the control panel, supplies power to the drive means, or power driven rollers 26, which then convey the fiber module 21 and pallet 22 onto the bed 40.

Thus, it is seen that the transfer means, or shuttle carriage 20, provides an efficient and expeditious apparatus for removing a fiber module from a trailer and conveying it to bed 40. The truck alignment problems present in prior art apparatus are eliminated and trailer unloading time is greatly decreased, which increases the efficiency of the overall system. The truck is able to drive straight alongside the bed 40 and the only alignment necessary to effect unloading is to merely stop the truck so that the end of the trailer is approximately aligned with the end of the bed 40. This is readily accomplished by any suitable manner, such as, for example, having a workman signal the truck driver when to stop, or by having a suitable line painted alongside the bed so that when the front of the truck reaches that line, the driver stops his truck. The module guide rails 31 compensate for any alignment problems due to the location of the module upon the trailer, and it is readily apparent that it is simple task to align the shuttle carriage with the trailer. Furthermore, visibility problems due to nighttime operations or adverse weather conditions are eliminated.

it is to be understood that use of the shuttle carriage 20 is not restricted to transferring fiber modules 21 only from conventional trailers 36, but rather from any suitable carrier for transporting fiber modules. For example, railroad cars or even horse drawn wagons, etc., could be used for transporting fiber modules to the fiber module conveying and breaker apparatus disclosed herein.

Turning once again to FIGS. 1 and 2, the support means or generally horizontal bed 40 comprises a generally rectangular frame 41, which is supported above the ground by a plurality of legs 42. Two expanded metal catwalks 43, (portions of which are shown in FIG. 1) may be provided along the length of the bed 40, to enable workmen to view the device in operation and to service or repair the bed 40 or its related machinery. Disposed above and along the length of the frame 41, two module guide rails 44 are supported by a plurality of posts 45. The guide rails extend from one end of the bed 40, generally designated as a fiber module receiving zone 46, toward a location, spaced from such receiving zone, generally designated as a fiber module delivery zone 47. As best seen in FIG. 1, the space between the guide rails 44 is slightly tapered near the delivery zone 47 and into the breaker device 80, which is located adjacent the delivery zone 47.

Disposed within the frame 41 are a plurality of idler rollers 48 and sets of power driven rollers 49, 50, 51, and 52 which, along with their related power source and power transmitting apparatus to be hereinafter discussed, comprise the drive means for conveying a fiber module 21 along the bed 40 from the receiving zone 46 to the delivery zone 47. While four sets of power driven rollers are illustrated, any number of sets could be used depending upon the length of the bed 40 and the number of rollers within each set. The ends of all of the rollers within the power driven roller sets 49-52 are provided with suitable sprockets (not shown) for engagement with a plurality of interconnected chain belts 53. Thus, if a rotational movement of a certain speed is provided to one roller within a power driven roller set 49-52, the interconnecting chain belts assure that the adjacent rollers within each set 49-52 will rotate at that same speed.

in the embodiment illustrated, one roller of each power driven roller set 49-52 has associated with it a gear box 54-57, preferably having a 5 to 1 gear ratio. These gear boxes 54-57 are mounted along one side of frame 41. The gear boxes 54-57 are mechanically interconnected by drive shafts 58-60. Additionally, the set of power driven rollers 52, which is generally located at the fiber module receiving zone 46, is provided with another gear box 61., located beneath and supported by frame 41. Gear box 61, which preferably has a 1 to 1 gear ratio, is operatively connected to a roller of set 52 by means of a chain belt 62. A drive shaft 63 is associated with gear box 61 and is also located beneath and supported by frame 41.

A suitable variable speed electric motor 64, located beneath the frame 41, serves as the power source for driving the various sets of power driven roller sets 49-52. It would, of course, be possible to use a hydraulic motor or any other suitable power device to supply power to roller sets 49-52. As best seen in FIG. 2, motor 64 has a shaft 65 protruding from it upon which are mounted two chain belts 66 and 67, which are operatively connected to drive shafts 59 and 63 by suitable sprockets (not shown) attached to the drive shafts 59 and 63. Upon shaft 65, between chain belts 66 and 67, there are mounted two clutch mechanisms 68 and 69, which preferably are air operated clutches. Drive shafts 59 and 60 also have similar clutch mechanisms 70 and 71 mounted thereon, adjacent gear box 56.

A feature of the invention is the ability of the drive means to convey the fiber modules in a continuous stream along the bed 40 to the breaker device 80. In other words, it is desired to have the fiber modules in an abutting relationship as they are conveyed into the breaker device 80. This enables the breaker device 80 and subsequent fiber treating apparatus, such as a cotton gin, to have a steady, constant supply of fiber material and to remain in continuous operation. Such continuous operation is more economical than intermittent operation, which results when the fiber modules are not being conveyed to the breaker device 80 in an abutting relationship. In accordance with this aspect of the invention, the operation of the drive means of the bed 40 will now be described with reference to FIGS. 1 and 2. With motor 64 operating to rotate shaft 65 and clutches 68, 70, and 71 engaged, all sets of power driven rollers 49-52 will be rotating at the same speed to convey fiber modules along bed 40 into the breaker device 80. As an example, many breaker devices require a fiber module to be conveyed into it at the rate of two feet per minute, in order to supply an adequate amount of fiber material into subsequent fiber treating apparatus, such as a cotton gin. Accordingly, the sets of power driven rollers 49-52 should convey a continuous stream of abutting fiber modules into the breaker device 80 at a speed of two feet per minute. However, it is readily apparent that during the time a fiber module 21 is being transferred from a trailer 36, onto the shuttle carriage 20 and conveyed onto the receiving zone 46 of bed 40, the fiber modules previously conveyed have travelled along the bed 40 a certain distance. Thus it is necessary to increase the speed of a subsequent fiber module so that it can "catch up" and "bump", or abut, the preceding fiber modules.

To accomplish this "bumping", or abutting movement, clutch 71 is disengaged and clutch 69 is engaged. Thus, the set of power driven rollers 52 is being rotated by gear box 61, rather than by gear box 57. Since gear box 61 preferably has a gear ratio of 1 to 1, whereas gear boxes 54-56 preferably have a gear ratio of 5 to 1, the set of power driven rollers 52 being rotated by gear box 61 will be rotating five times faster than the sets of power driven rollers 49-51 being rotated by gear boxes 54-56. Therefore, if roller sets 49-51 are driving fiber modules into the breaker device 80 at a speed of two feet per minute, roller set 52 will be driving the fiber module being conveyed onto the bed 40 at a speed of ten feet per minute. This higher speed will be maintained until the fiber module abuts the preceding fiber module at some point between roller set 51 and 52. Thereafter, clutch 71 would be engaged and clutch 69 disengaged to enable the abutting fiber modules to be conveyed at the same speed into the breaker device 80. It is to be understood that the speed at which the shuttle carriage 20 conveys the fiber module onto bed 40 is synchronized with the speed at which roller set 52 is operating.

If in the event the preceding fiber modules have been conveyed beyond roller set 51, clutch 70 is disengaged and clutch 69 is engaged. This enables roller set 52 to convey a fiber module along bed 40 at a higher speed until the fiber module abuts the preceding fiber module at a point located between roller sets 50 and 51. After the fiber modules are all in an abutting relationship, clutch 70 is engaged and clutch 69 is disengaged.

A suitable control panel may be provided somewhere along the outside of bed 40 to control the operation of the motor 64 and clutches 68-71. Alternatively, the controls may be incorporated into the control panel 34 on the shuttle carriage operator's platform 33. An additional control device for the motor 64 may be placed within the cotton gin, so that the speed of the motor could be increased or decreased if more or less fiber material for the cotton gin is desired.

From the foregoing it is seen that an efficient drive means and control system has been provided which enables the conveyance of a plurality of fiber modules in an abutting relationship along a bed into a breaker device. The disclosed clutch and gear box arrangement enables the fiber modules to be abutted in a variety of different locations along the length of the bed, thus assuring continuous operation of the breaker device and subsequent fiber handling apparatus. Adequate speed control enables varying rates of fiber module movement in accordance with the amount of fiber material required by the breaker device.

It would, of course, be possible to use hydraulic motors with suitable transmissions or any other suitable power devices to rotate the sets of power driven rollers herein described. Likewise any suitable type of clutch and controls therefor may be used to provide the desired speed control. Also, while gear ratios of 1:1 and 5:1 are recited as preferred, different gear ratios can easily be employed, consistent with achieving the desired "bumping".

Figure 4:
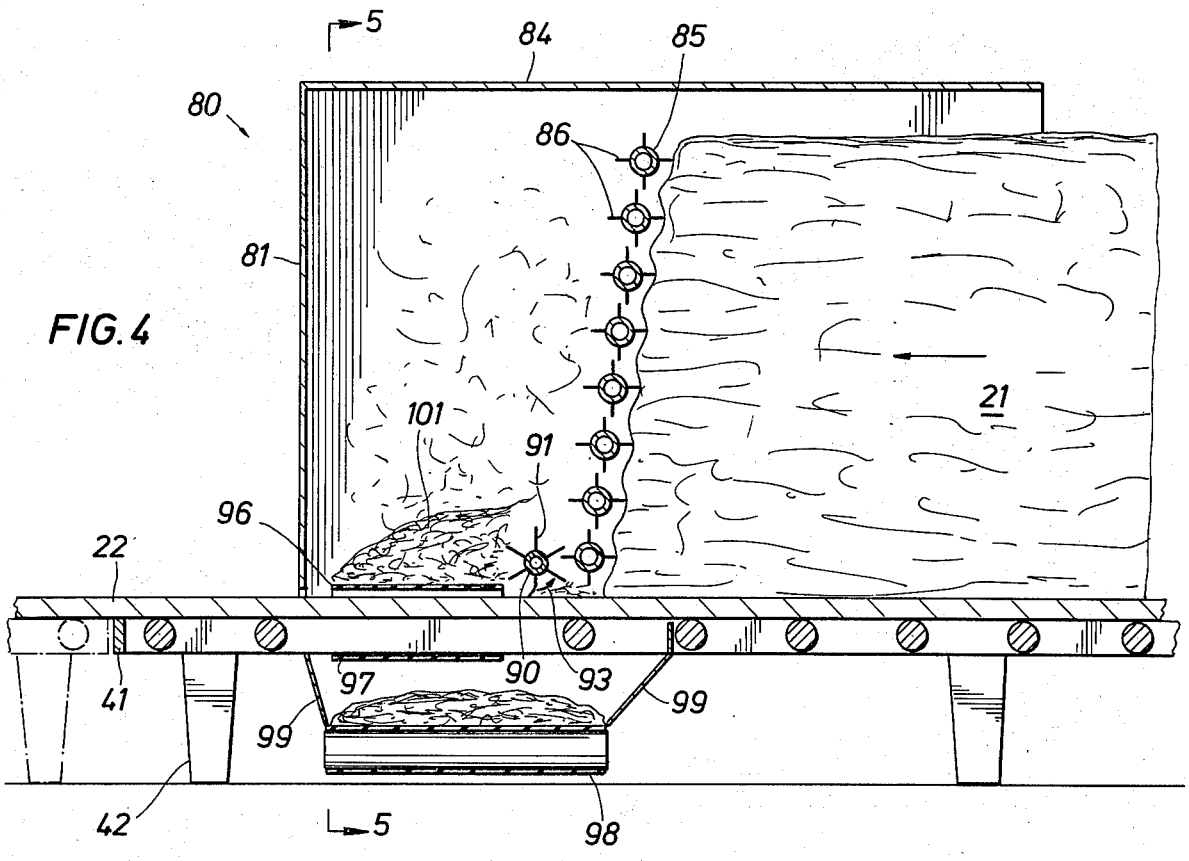
FIG. 4 is a longitudinal cross sectional view taken along line 4—4 of FIG. 3.
Figure 5:
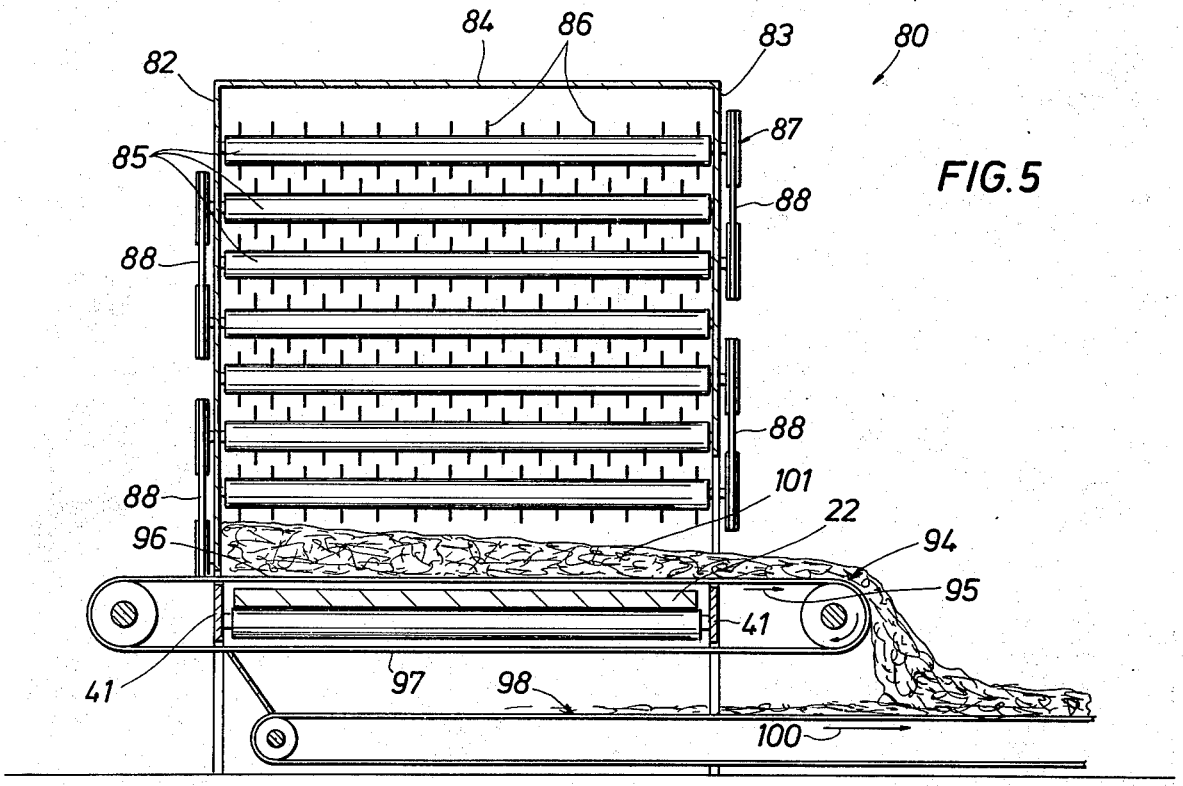
FIG. 5 is a cross sectional view taken along line 5—5 of FIG. 4.

Turning once again to FIG. 2, the breaker device 80, or means for breaking apart the fiber modules, is shown to be located adjacent the fiber module delivery zone 47 and disposed above the bed 40. As best seen in the embodiment of FIGS. 4 and 5, the breaker device includes three vertical walls 81-83 supported upon the frame 41 and a top member 84 attached to the walls 81-83. Horizontally supported between walls 82 and 83 are a plurality of rotary breaker tubes 85, each having a plurality of spikes 86 spaced along their lengths and spaced around their circumferences. As best seen in FIGS. 1 and 5 each breaker tube has a pulley 87 attached to an outer end, and pairs of pulleys 87 are drivingly connected by a drive belt 88 to a suitable motor 89. In the embodiment illustrated, four motors 89 are provided for driving eight breaker tubes. Two motors 89 are mounted on each wall 82 and 83. Wall 81 is spaced above the frame 41 to enable a pallet 22 to pass beneath the wall 81, as best seen in FIG. 4. A pallet sweeper 90 having a plurality of flexible sweeper blades 91 mounted thereon, is supported between walls 82 and 83 and positioned so that the sweeper blades 91 will come into contact with the top of a pallet 22 passing beneath the blades 91. An appropriate motor 92 is mounted on wall 83 for rotating the pallet sweeper 90 in the direction of arrow 93. An endless conveyor belt is traversely mounted across frame 41 for rotation in the direction shown by arrow 95. The conveyor belt 94 is positioned so that its upper surface 96 passes over the frame 41 and allows a pallet 22 to pass beneath it and its lower surface 97 passes beneath frame 41, as best seen in FIGS. 4 and 5. Located below conveyor belt 94 is another conveyor belt 98 supported from frame 41 by struts 99. Conveyor belt 98 moves in the direction shown by arrow 100 in FIG. 5.

In operation, a fiber module 21, conveyed into the breaker device by roller set 49, is engaged by the spikes 86 of the rotating breaker tubes 85 and is broken apart, or separated, into many loose uncompacted fibers 101, which fall upon the moving upper surface 96 of conveyor belt 94. The uncompacted fibers are then removed from the breaker device 80 by the conveyor belt 94 which deposits them upon conveyor belt 98. Conveyor belt 98 carries the fibers to subsequent fiber processing apparatus, such as a cotton gin. Any fibers remaining upon the pallet 22 are swept upon conveyor belt 94 by the rotating blades 91 of the pallet sweeper 90. The empty pallets 22 are then conveyed beyond the breaker device 80 where they can be stacked by a suitable machine or by manual means.

At this point it should be noted that the conveyor belt 94 could feed the loose fibers 101 to a suction device or other suitable conveying device, rather than the conveyor belt 98. Additionally, rotary breaker tubes 85 could be made from solid rod stock rather than tubular stock. With regard to the breaker tubes 85, advantages have been achieved with the design shown over those of the prior art, e.g., the spiral auger of Wilkes et al U.S. Pat. No. 3,879,018. The breaker tubes 85 remain horizontal when they are rotated and do not flex, or bow in, at the middle, thus achieving a more even breaking apart of the fiber module and eliminating any vibration problems. Furthermore, they are more economical to manufacture.

Figure 6:
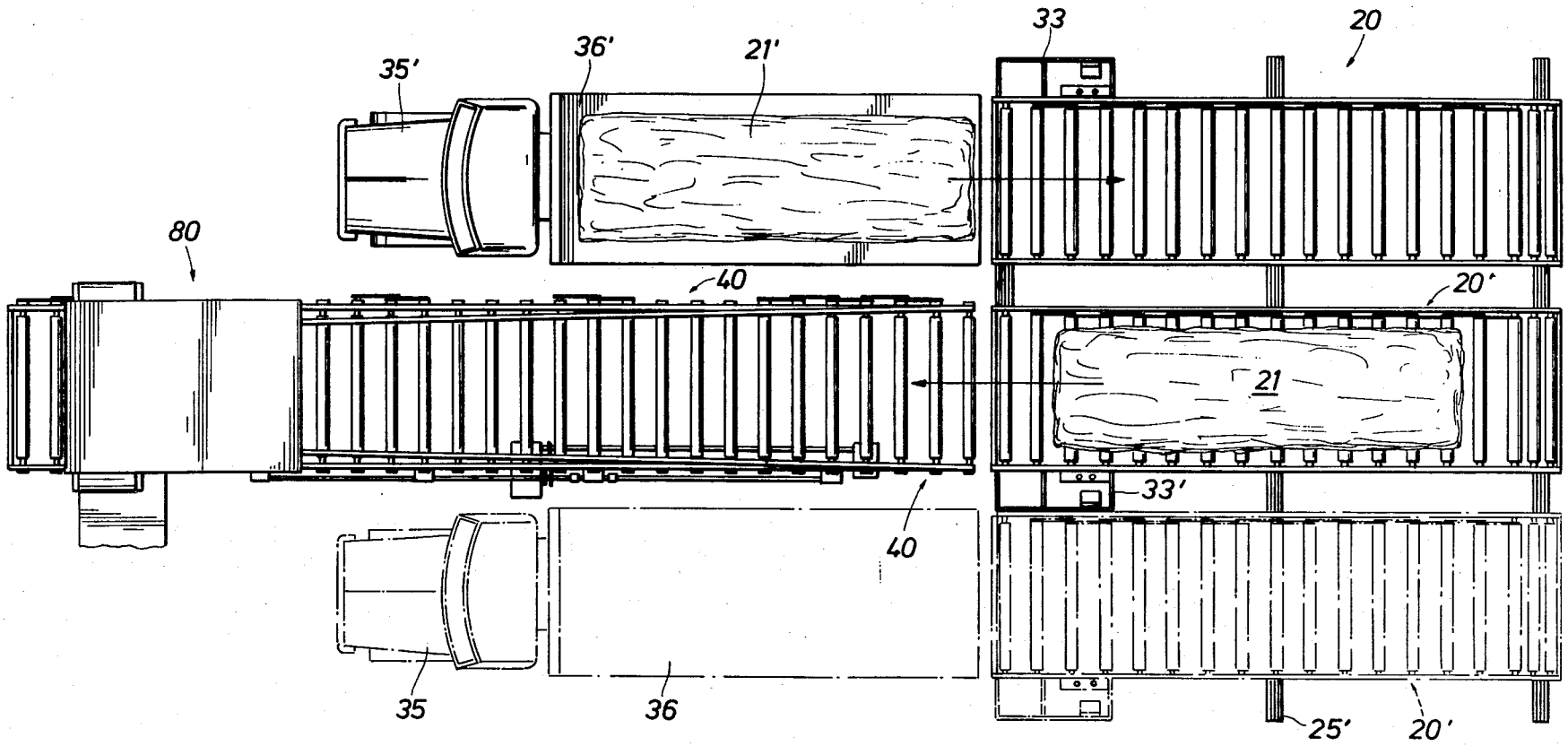
FIG. 6 is a plan view of another embodiment of the apparatus of FIG. 2.

Turning now to FIG. 6, another embodiment is shown wherein the breaker device 80 and bed 40 is the same as previously described, but two shuttle carriages 20 and 20′ are provided. As illustrated shuttle carriages 20 and 20′ are identical except for the location of the operator platforms 33 and 33′. Shuttle carriage 20′ is a mirror image of shuttle carriage 20. This different location of operator platforms 33 and 33′ is necessary to ensure that operator platform 33′ is not compressed between the two carriages 20 and 20′, if they were to be moved too close to one another. Additionally, tracks 25′ extend to two locations located laterally from the bed.

As is clearly apparent from FIG. 6, the use of two shuttle carriages 20 and 20′ enables one truck 35′ to remove its fiber module 21′ from its trailer 36′ onto shuttle carriage 20, while another fiber module 21, which has previously been moved onto shuttle carriage 20′, is being conveyed onto the receiving zone 46 of bed 40. Thus the flow of fiber modules onto the bed 40 is made more continuous and there is a resulting time savings for trucks waiting to unload their fiber modules.

In some areas of the United States cotton can be harvested and then compacted into a fiber module, but without compacting it onto a pallet. In these areas, for example, West Texas, ground moisture is not a problem that could affect the unpalletized fiber modules. These modules can be transported to the conveying and breaker apparatus by means of suitably modified flat bed trailers, which have a driven endless conveyor belt located upon the bed of the trailer.

By downwardly tilting the trailer and then simultaneously backing up the trailer under the unpalletized fiber module, while moving the upper surface of the endless conveyor belt in a direction toward the front of the truck, the unpalletized cotton module is transferred onto the bed of the trailer.

The only necessary modification to the present invention to enable it to accommodate unpalletized fiber modules is the substitution of endless chain conveyor belts in lieu of the rollers 26, 27 and 48-52 and the deletion of the winch 29. For example, for the shuttle carriage 20 as shown in FIGS. 1 and 2, a single power driven endless chain conveyor belt extending the entire length of the shuttle carriage 20, and having a width approximately the width of frame 23, would be used in lieu of rollers 26 and 27. For the bed 40, four power driven endless conveyor chain belts would be used in lieu of driven roller sets 49-52 and idler conveyor chain belts would be provided at the locations wherein idler rollers 48 are located. Such a modified shuttle carriage and bed would achieve the same advantages for the efficient conveying of unpalletized fiber modules as have been previously described for palletized fiber modules.

The foregoing description of the invention has been directed in primary part to particularly preferred embodiments in accordance with the requirements of the Patent Statutes and for purposes of explanation and illustration. It will be apparent, however, to those skilled in this art that many modifications and changes in the specific apparatus utilized may be made without departing from the scope and spirit of the invention. For example, the shuttle carriage could be supported by a travelling overhead crane. It is applicant's intention in the following claims to cover such modifications and variations as fall within the true spirit and scope of the invention.

I claim:

1. An apparatus for conveying and breaking apart fiber modules comprising in combination:

means for supporting at least one fiber module in a generally horizontal position, said support means having a fiber module receiving zone at one end thereof, and a fiber module delivery zone, spaced from said receiving zone;

means for breaking apart a fiber module, said breaker means located adjacent the fiber module delivery zone of said support means; first drive means for conveying a fiber module along said support means from said receiving zone to said breaker means, wherein the first drive means includes a plurality of sets of power driven rollers, one of said sets being generally located at said fiber module delivery zone and at least one of said sets being generally located intermediate said fiber module delivery zone and said fiber module receiving zone, each of said sets having associated therewith at least one gear box for rotating said sets of power driven rollers; one set of said power driven roller sets, generally located at the fiber module receiving zone, having associated therewith two gear boxes of different gear ratios capable of operating said one set of power driven rollers at a first speed being equal to the speed at which said set generally located at said delivery zone operates, and at a second speed which is substantially greater than said first speed; and clutch means, associated with said set generally located at said receiving zone and with said set generally located intermediate said receiving zone and said delivery zone, for enabling said set generally located at said receiving zone to convey a fiber module along said support means at said second speed until the fiber module abuts a fiber module, which has previously been conveyed along said support means, at a location beyond said set generally located intermediate said receiving zone and said delivery zone;

means for removing the broken apart fiber module from said breaker means;

a shuttle carriage for transferring a fiber module from a first location laterally displaced from the support means to a second location which is axially aligned with the receiving zone of said support means, said shuttle carriage including a frame and a generally horizontal fiber module receiving surface; and second drive means for conveying a fiber module from said shuttle carriage to the receiving zone of said support means, said second drive means including a plurality of rotatably mounted power driven rollers comprising said generally horizontal fiber module receiving surface, said rollers being operable to convey a fiber module from said shuttle carriage to the fiber module receiving zone of said support means.

2. The apparatus of claim 1 wherein the plane of the fiber module receiving surface of said shuttle carriage is on the same plane as that of said support means.

3. The apparatus of claim 1 wherein the frame of said shuttle carriage is mounted on wheels for lateral movement along tracks.

4. The apparatus of claim 1 wherein two shuttle carriages are provided, each shuttle carriage being adapted for movement from a first location laterally of said supporting means to a second location axially aligned with said support means.

5. The apparatus of claim 4 wherein each of said shuttle carriages includes a frame and a generally horizontal fiber module receiving surface.

6. The apparatus of claim 5 wherein the frames of said shuttle carriages are mounted on wheels for lateral movement along tracks extending to locations on both sides of said support means, whereby when one shuttle carriage is conveying a fiber module to the receiving zone of said support means, the other shuttle carriage can receive a fiber module from a carrier.

7. The apparatus of claim 1 wherein said breaker means comprises a plurality of rotary breaker tubes, each of said breaker tubes having a plurality of spikes placed along its length and circumference.

8. The apparatus of claim 1 wherein the removal means for broken apart fibers comprises a conveyor belt located beneath said breaker means.

9. The apparatus of claim 1 wherein said shuttle carriage includes a fiber module guide means disposed along the length of the shuttle carriage, whereby a fiber module being pulled upon the shuttle carriage is guided into axial alignment with respect to the shuttle carriage.

10. The apparatus of claim 9 wherein said fiber module guide means comprises a pair of guide rails extending above said fiber module receiving surface.

* * * * *